US006007013A

United States Patent [19]

Schlatter et al.

[11] Patent Number: 6,007,013

[45] Date of Patent: Dec. 28, 1999

[54] WINDING AID FOR THIN TAPES IN STRIP FORM

[75] Inventors: Manfred Schlatter, Freiburg; Heinz Schnee, Rheinau; Manfred Kraus, Kehl, all of Germany

[73] Assignee: EMTEC magnetics GmbH, Ludwigshafen, Germany

[21] Appl. No.: 09/041,697

[22] Filed: Mar. 13, 1998

[30] Foreign Application Priority Data

Mar. 17, 1997 [DE] Germany ..... 297 04 833 U

[51] Int. Cl.[6] ..... G11B 23/04; G11B 15/32

[52] U.S. Cl. ..... 242/346.1; 242/324; 242/346.2; 242/615.2; 242/615.3

[58] Field of Search ..... 242/324, 548.2, 242/548.3, 615.2, 615.3, 346.1, 346.2

[56] References Cited

U.S. PATENT DOCUMENTS 3,841,582 10/1974 Schaeffer et al. ..... 242/199

5,533,690 7/1996 Kline et al. ..... 242/548.3

FOREIGN PATENT DOCUMENTS 44 47 032 7/1996 Germany .

OTHER PUBLICATIONS

Firmenmitteilung, AGFA, Band Professinal, May 1998, Nr. 10, S. 1–3.

*Primary Examiner*—John Q. Nguyen
*Attorney, Agent, or Firm*—Keil & Weinkauf

[57] ABSTRACT

A winding aid for thin tape strips on tape reels or hubs with or without flange(s) comprises a winding arm having a stationary winding surface and rotatable guiding surface(s) arranged adjacent and perpendicular thereto. This improves the quality of the rolls of tape produced from thin tape strips, such as films, magnetic tapes etc.

11 Claims, 2 Drawing Sheets

WINDING AID FOR THIN TAPES IN STRIP FORM

FIELD OF THE INVENTION

The invention relates to a winding aid for thin tapes in strip form, in particular magnetic tapes, on tape reels with or without at least one flange.

PRIOR ART

When winding up thin tape strips, it is very important to achieve a satisfactory appearance of the roll of tape, without protruding turns of tape. This is achieved, for example according to DE-C-2 115 124, by producing a roll of tape of outstanding appearance by means of a winding arm in contact with the circumference of the tape winder.

The company bulletin "AGFA Band Professional", No. 10, May 1988 discloses that, for winding up magnetic recording media, in which even tape material of extreme lengths, known as pancakes, as to be wound onto a flangeless winding hub, in process engineering terms two designs are available, the contact winders and the central winders.

In the contact winding process, the tape is taken sideways by a tape guiding roller, which is designed in one piece with lateral flanged disks, and transferred onto a relatively large, driven cylinder. From this cylinder, the tape runs into the winding element, the drive of the roll taking place at its circumference by the contact with the driven cylinder. To compensate for the changing diameter of the roll, the tape winding element is pivotably mounted.

Conversely, in the central winding process, the tape winding element, or the winding hub, is driven and the tape runs onto the roll via a movable tape guide.

DE-A-44 47 032 discloses such a movable tape guide, in which a guiding roller, likewise formed in one piece with flanged disks, is kept at a predetermined distance from the circumference of the roll of tape, so that the flanged disks just reach over and under the outer turns of tape over the circumference of the roll of tape at all times.

SUMMARY OF THE INVENTION

It is an object of the present invention to produce a roll of tape of a satisfactory appearance under spatially restricted conditions by winding into a flanged reel and/or into a confined housing.

We have found that this object is achieved with a winding aid for thin tapes in strip form, in particular magnetic tapes, on tape reels with or without at least one flange if a winding arm having a stationary winding surface and at least one guiding surface, arranged in the vicinity of and normal to the winding surface, is provided, the guiding surface being formed by a rotatably mounted guiding disk.

In this way, rolls of tape can be produced on reels or winding hubs, in the case of which there is no space for the known winding aids, with an excellent appearance of the roll, even at very high winding speeds and with very thin tape strips.

In a practical embodiment, the guiding disk may be provided with a shaft, and said shaft may be mounted in at least one ball bearing arranged behind the winding surface in the winding arm. In a further practical embodiment, the winding arm may be fastened on the displaceable part of a two-part longitudinal guiding means, comprising a stationary part and a displaceable part.

In an advantageous embodiment, a threaded nut, which can be moved on a threaded spindle, may be fastened to the displaceable part of the longitudinal guiding means. It may also be expedient if the threaded spindle can be driven in a controlled manner by means of a stepping motor.

It is favorable for the overall height of the winding arm if the height of the winding surface corresponds to about 75% of the width of the tape in strip form to be wound up.

BRIEF DESCRIPTION OF THE DRAWINGS

Exemplary embodiments of the invention are described below with reference to the drawing, in which.

DESCRIPTION OF THE PREFERRED EMBODIMENT

Figure 1:
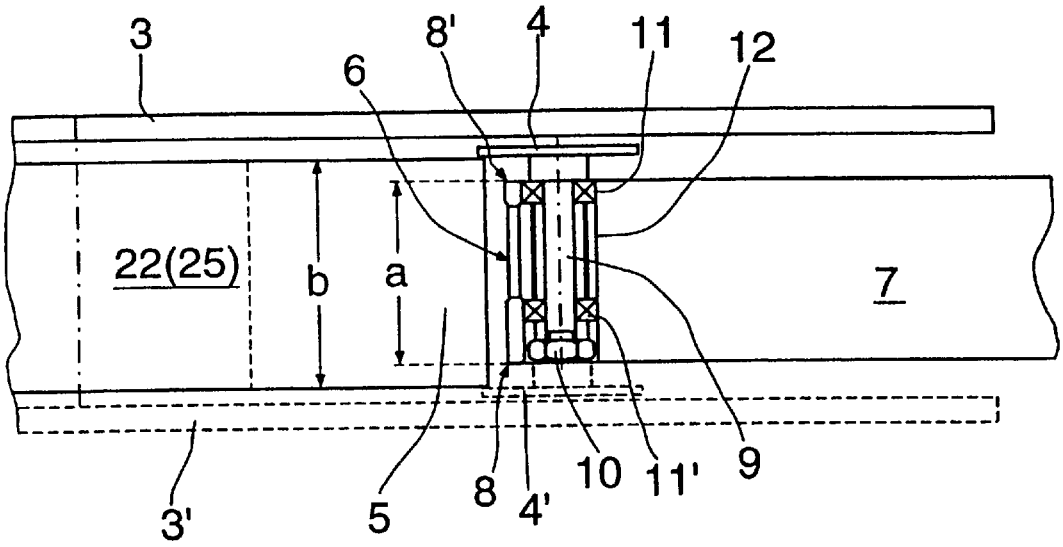
FIG. 1 shows a single-flange or double-flange reel with a roll of tape and a winding aid in side view

The winding aid 2 comprises a winding arm 7, which is fastened on the sliding part 14, which is mounted longitudinally displaceably on the stationary part 20 of a longitudinal guiding means 21 by means of rolling-contact bearings. Securely connected to the sliding part 14 is a threaded nut 15, which is longitudinally displaceable on a threaded spindle 16 when the latter is rotated and consequently permits the longitudinal movement of the sliding part 14. The threaded spindle 16 is connected via a coupling 17 to the drive shaft 18 of a stepping motor 19, so that when there is predetermined activation of the stepping motor 19 a desired longitudinal movement of the sliding part 14, and consequently of the winding arm 7, can be accomplished.

The sliding part 14 may similarly be driven by means of a motor-driven cable control system or a magnetic longitudinal drive system, as known from positioning devices in information recording and playback systems with information media in disk form. The winding arm 7 is fastened on the sliding part 14 by means of screws 13, 13'.

Provided at the free end of the winding arm 7 is a stationary winding surface 6, which has a convex shape and is to be polished. The winding surface 6 is formed in its vicinity, ie. in the vicinity of its vertical extent (height a, in FIG. 1), and perpendicular (normal) thereto with a guiding surface, which in this case is the underside of a rotatably mounted guiding disk 4.

The tape to be wound up on the roll of tape 5 or on the empty reeling hub or winding hub 22 or 25 is transported via the convex winding surface 6, using the effect that, at a sufficiently high relative speed, the entrainment of the air boundary layer causes an air cushion carrying the tape to form between the tape and the winding surface 6. The minimum speed for forming this air cushion, depending on roughness values, angles of wrap and tape tension, is about 2 to 4 m/s. The winding speed which can be achieved with the winding aid 2 described is much higher, however. At lower winding speeds, the winding surface 6 may be provided with air outlet openings, which are connected to an air source, in order to produce an air cushion in every case. It has surprisingly been found that an air cushion width (corresponding to the height a of the winding surface) of 75% of the width b of the tape to be wound is already adequate for satisfactory tape guidance. The upper and lower edges 8 and 8' of the winding surface must, however, also be rounded off and polished. The guiding disk 4 is fastened on a shaft 9 and secured against axial displacement by a screwed union 10. The shaft 9 is expediently mounted freely rotatably in at least one, in FIG. 1 in two ball bearings 11 and 11', the ball bearings 11 and 11' being provided in a bore 12 behind the winding surface 6 on the winding arm 7. As shown in solid lines, just one guiding disk 4 may be provided, which with its underside as a guiding surface just covers the outer circumference of the roll of tape 5, as FIG. 1 shows, so that the outer turns of the roll of tape 5 are guided at the upper edge. In the case of this guiding disk 4 on one side, the lower edge of the tape to be wound up is wound in slight contact with the inner surface of the lower reel flange 3', shown in broken lines. However, a lower guiding disk 4', indicated in broken lines, may also be used on its own or with the upper guiding disk 4 on a common shaft 9, the tape then either being wound in contact with the underside of the upper reel flange 3, shown in solid lines, or between the two guiding surfaces of the upper and lower guiding disks 4 and 4'.

If 3 and 3' denote reel flanges, the reeling in of the tape onto the reeling hub 22 or 25 is effected by rotary driving of the reel. If only a flangeless winding hub 22 or 25 is provided, having a housing surface corresponding to one of the inner surfaces of the flanges 3 and 3', this housing surface represents the contact surface when there is a guiding disk 4 or 4' on one side.

In order to avoid damage to the surface of the tape, it is favorable if a small but constantly provided distance is maintained between the winding surface 6 and the outer circumference of the roll of tape 5 or of the reeling hub or winding hub 22, 25, which is also necessary in order for the guiding surface(s) of the guiding disk(s) 4 (and 4') to reach just over the outer circumference of the roll of tape 5, in order to guide in each case only the outermost turns of tape during winding up.

This distance adjustment can be accomplished by suitable controlling of the stepping motor 19, and consequently of the longitudinal movement of the winding arm 7 with the winding surface 6 and the guiding disk or disks 4 (and 4') with respect to the roll of tape 5.

The controlling must be performed in dependence on the change in diameter of the roll of tape 5, but speed-independently, since the winding aid 2 is to be used independently of the respective reeling speed. This means that, although the winding aid 2 must always move at the predetermined distance in front of the roll of tape 5, irrespectively of how fast winding is carried out or how quickly the winding diameter increases, this assigned distance between them must not be lost, in order not to lose the effect of the guiding disk(s) 4 (and 4') reaching over the roll of tape 5.

Figure 2:
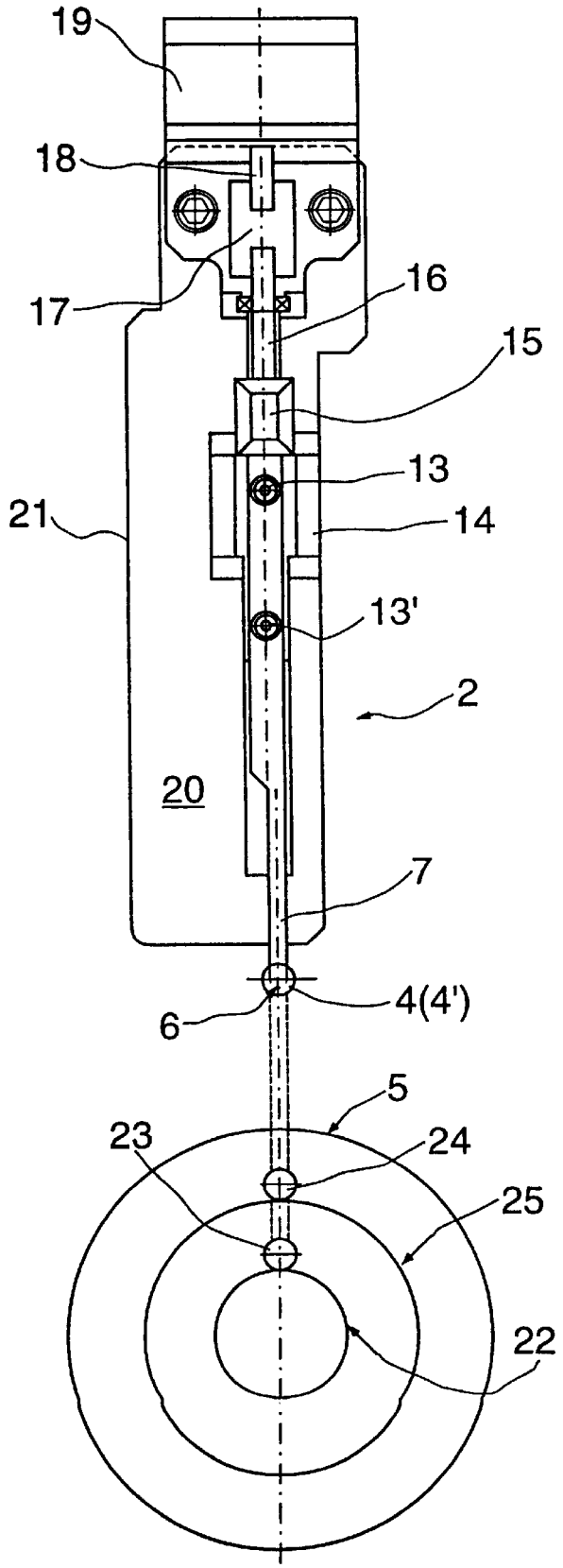
FIG. 2 shows a winding hub with a roll of tape and a winding aid.

Various positions of the winding arm 7 with respect to the roll of tape 5 and with respect to differently sized reeling hubs or winding hubs 22 (position 23) and 25 (position 24) and also the basic position in front of the roll of tape 5 are shown in FIG. 2. The winding aid 21 according to the invention produced rolls of tape of outstanding appearance, with peak-to-valley depths of the tape-roll side surfaces in the range Rz from about 10 to about 20 MM.

The above invention relates to a winding aid for thin tape strips on tape reels or hubs with or without flange(s); it comprises a winding arm having a stationary winding surface and rotatable guiding surface(s) arranged adjacent and perpendicular thereto. This improves the quality of the rolls of tape produced from thin tape strips, such as films, magnetic tapes etc.

We claim:

1. A winding aid for thin tapes in strip form, in particular magnetic tapes, on tape reels with or without at least one flange, wherein a winding arm having a stationary winding surface and at least one guiding surface, arranged in the vicinity of and normal to the winding surface, is provided, the guiding surface being formed by a rotatably mounted guiding disk said winding surface being parallel to the tape surface and structured so that an air cushion is formed between the winding surface and the tape as said winding surface guides the tape onto a reel, and said guiding surface is structured to guide the edge of the tape on the reel.

2. The winding aid of claim 1, wherein at least one ball bearing for a shaft bearing the guiding disk(s) is provided behind the winding surface.

3. The winding aid of claim 1, wherein the arm is fastened on the displaceable part of a two-part longitudinal guiding means comprising a stationary part and a displaceable part.

4. The winding aid of claim 3, wherein a threaded nut, which is threaded on and can be moved longitudinally on a threaded spindle, is fastened to the displaceable part.

5. the winding aid claim 4, wherein the threaded spindle can be driven in a controlled manner by means of a stepping motor.

6. The winding aid of claim 1, in which a height (a) of the winding surface corresponds to about 75% of the width (b) of the tape in strip form to be wound up.

7. The winding aid of claim 1, wherein the stationary winding surface has a convex shape and is polished.

8. The winding aid of claim 7, wherein the stationary winding surface is provided with air outlet openings.

9. A process for winding thin tape in strip form, in particular magnetic tape, on tape reels with or without at least one flange, comprising simultaneously transporting the tape to a reeling hub or a winding hub of a tape reel via an air cushion formed between a convex, polished, stationary winding surface and the tape, said winding surface being parallel to the tape surface and guiding the edge of the tape on the reel with a guiding surface which is rotatably mounted to an which extends normal to the winding surface, said guiding surface being in the vicinity of the winding surface.

10. The process of claim 9 wherein the winding surface has a height which corresponds to about 75% of the width of the tape to be wound.

11. The process of claim 9 wherein the reeling hub or winding hub is located inside a cassette housing during the transporting and guiding steps.

* * * * *

UNITED STATES PATENT AND TRADEMARK OFFICE

CERTIFICATE OF CORRECTION

PATENT NO.: 6,007,013

DATED: December 28, 1999

INVENTOR(S): SCHLATTER et al.

It is certified that error appears in the above-identified patent and that said Letters Patent is hereby corrected as shown below:

On the cover page, item [30], "297 04 833 U" should be --297 04 833.3--.

Col. 4, claim 1, line 12, delete the comma after "guiding surface".

Col. 4, claim 5, line 28, "the winding" should be --The winding--.

Col. 4, claim 9, line 46, "to an" should be --to and--.

Signed and Sealed this

Fifteenth Day of August, 2000

*Attest:*

Q. TODD DICKINSON

*Attesting Officer*

*Director of Patents and Trademarks*